US006281744B1

(12) United States Patent
Kang

(10) Patent No.: US 6,281,744 B1
(45) Date of Patent: Aug. 28, 2001

(54) VOLTAGE DROP CIRCUIT

(75) Inventor: Dong Keum Kang, Cheongju (KR)

(73) Assignee: Hyundai Electronics Industries Co., Ltd., Kyoungki-Do (KR)

( * ) Notice: Subject to any disclaimer, the term of this patent is extended or adjusted under 35 U.S.C. 154(b) by 0 days.

(21) Appl. No.: 09/325,412

(22) Filed: Jun. 4, 1999

(30) Foreign Application Priority Data

Feb. 12, 1999 (KR) ..... 99/5028

(51) Int. Cl.[7] ..... G05F 1/10; G05F 3/02
(52) U.S. Cl. ..... 327/541; 327/543
(58) Field of Search ..... 327/538, 540, 327/541, 543, 545, 546

(56) References Cited

U.S. PATENT DOCUMENTS 5,485,117 * 1/1996 Furumochi ..... 327/538
5,493,234 2/1996 Oh ..... 326/33
5,504,452 * 4/1996 Takenaka ..... 327/541
5,557,193 9/1996 Kajimoto ..... 323/282
5,612,920 3/1997 Tomishima ..... 365/226

* cited by examiner

*Primary Examiner*—Terry D. Cunningham
*Assistant Examiner*—Quan Tra
(74) *Attorney, Agent, or Firm*—Morgan, Lewis & Bockius LLP

(57) ABSTRACT

A voltage drop circuit includes a comparator for comparing a predetermined reference voltage and a generated internal voltage, a first current supply unit for being activated in accordance with an output of the comparator, a level converter for converting the output of the comparator to a CMOS level, a second current supply unit for being activated in accordance with an output of the level converter, and a load circuit for receiving current from the first and second current supply units and forming an internal voltage.

3 Claims, 1 Drawing Sheet

VOLTAGE DROP CIRCUIT

BACKGROUND OF THE INVENTION

1. Field of the Invention

The present invention relates to a semiconductor memory device, and more particularly, to a voltage drop circuit for a semiconductor memory device.

2. Description of the Background Art

FIG. 1 is a circuit view illustrating a conventional voltage drop circuit which generates a stable internal voltage Vint. As shown therein, the conventional voltage drop circuit includes a comparator 10, a current supply unit 12 and a load circuit 14.

The comparator 10 includes a current mirror type amplifier and compares voltage levels of predetermined reference voltage Vref and internal voltage Vint using a negative feedback loop. The current supply unit 12 includes a PMOS transistor M1 connected between an external voltage Vext and an output terminal 50 thereof and it is activated in accordance with a comparison signal N1 of the comparator 10. The load circuit 14 is connected between the output terminal 50 and ground voltage Vss, thereby forming the internal voltage Vint in accordance with the current I1 from the current supply unit 12.

The operation of the conventional voltage drop circuit will now be explained.

If the internal voltage Vint is less than the predetermined reference voltage Vref, the comparator 10 outputs the comparison signal N1 at low level and turns on the PMOS transistor M1 of the current supply unit 12. As a result, the predetermined current I1 from the current supply unit 12 flows toward the load circuit 14 so as to form a predetermined level of interval voltage Vint.

When the internal voltage Vint is increased and accordingly the reference voltage Vref is increased, the comparator 10 outputs the comparison signal N1 at high level and turns on the PMOS transistor M1 of the current supply unit 12, whereby the current supply from the current supply unit 12 to the load circuit 14 is interrupted.

Therefore, the conventional voltage drop circuit repeatedly implements the above operation so as to maintain the internal voltage Vint at a constant level.

Presently, as memory capacity becomes highly integrated and miniaturized, an external voltage Vext is decreased to a low voltage (for example, 3.3V→2.5V). Here, when the external voltage Vext is decreased to a low voltage, a voltage Vds between source and drain of the PMOS transistor M1 of the current supply unit 12, thereby deteriorating a current supply capability of the current supply unit 12. As a result, when the load circuit 14 is driven, the internal voltage Vint may be disadvantageously unstable.

SUMMARY OF THE INVENTION

The present invention is directed to overcoming the disadvantages of the conventional voltage drop circuit.

Accordingly, it is an object of the present invention to provide a voltage drop circuit, capable of generating a stable internal voltage by improving a current driving capability of a current supply unit when an external voltage is decreased to a low voltage.

To achieve the above-described object, there is provided a voltage drop circuit according to the present invention which includes a comparator for comparing a predetermined reference voltage and a generated internal voltage, a first current supply unit for being activated in accordance with an output of the comparator, a level converter for converting the output of the comparator to a CMOS level, a second current supply unit for being activated in accordance with an output of the level converter, and a load circuit for receiving current from the first and second current supply units and forming an internal voltage.

The features and advantages of the present invention will become more readily apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
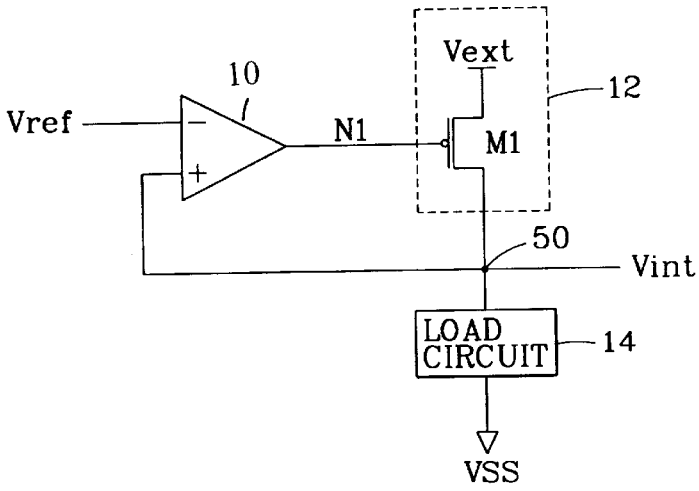
FIG. 1 BACKGROUND ART
FIG. 1 is a view illustrating a conventional voltage drop circuit.
Figure 2:
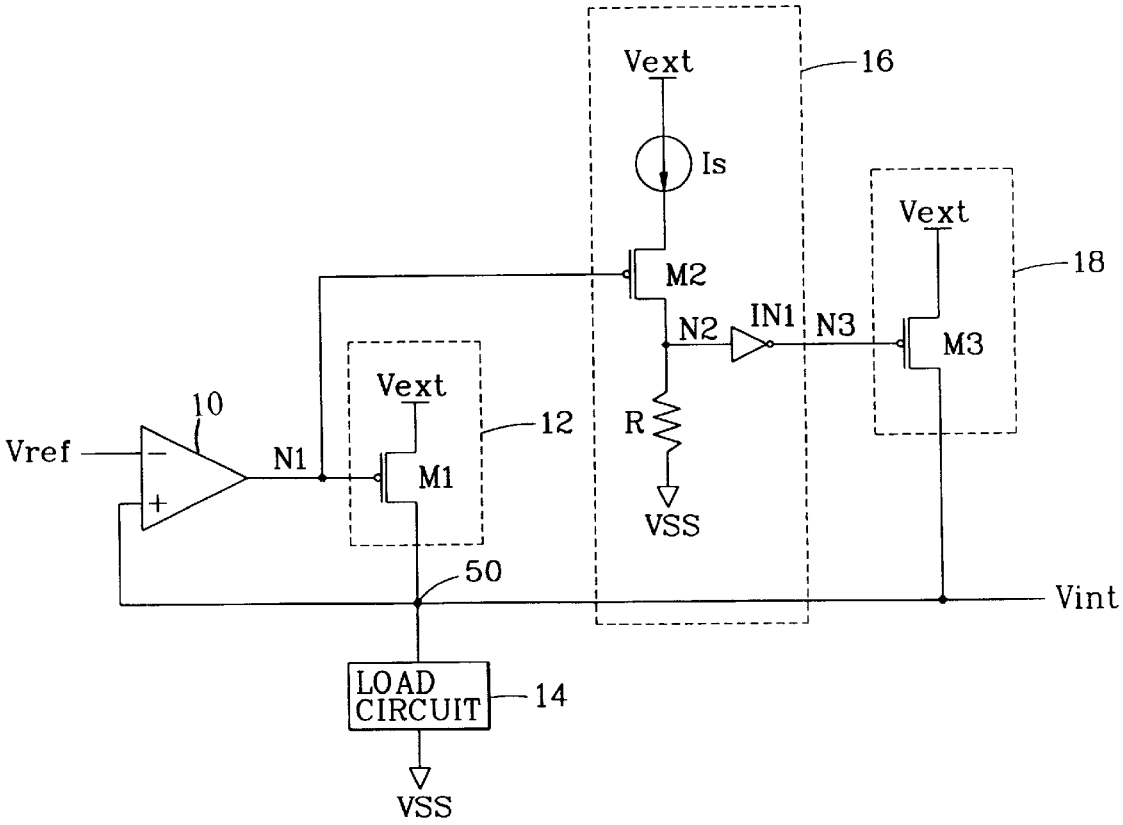
FIG. 2 is a view illustrating a voltage drop circuit according to the present invention.

FIG. 2 shows a voltage drop circuit according to the present invention.

As shown therein, the voltage drop circuit according to the present invention includes a comparator 10, first and second current supply units 12, 18, a load circuit 14 and a level converter 16.

Respective compositions and operations of the comparator 10, the first current supply unit 12 and the load circuit are identical to those of the conventional art. The level converter 16 converts the output of the comparator 10 to a CMOS level so as to activate the second current supply unit 18. Also, the second current supply unit 18 is driven in accordance with an output N3 of the level converter 16 and supplies current 12 to the load circuit 14.

The level converter 16 includes a static current source is serially connected between an external voltage Vext and ground voltage Vss, a PMOS transistor M2 and resistance R, and an inverter IN1 connected between the drain of the PMOS transistor M2 and the second current supply unit 18. The second current supply unit 18 includes a PMOS transistor M3 connected between the external voltage Vext and an output terminal 50 thereof.

The operation of the voltage drop circuit according to the present invention will now be described.

When an internal voltage is less than a predetermined reference voltage Vref, the comparator 10 outputs a comparison signal N1 at low level and turns on the PMOS transistor M1 of the first current supply unit 12. Accordingly, the predetermined current I1 flows from the current supply unit 12 toward the load circuit 14 in the same mechanism as discussed in the conventional art. Here, when the external voltage Vext is decreased from 3.3V to 2.5V, the voltage Vds between source and drain of the PMOS transistor M1 is also decreased, thereby deteriorating the current driving capability of the first current supply unit 12.

At this time, since the PMOS transistor M2 of the level converter 16 is turned on in accordance with a low level comparison signal N1 from the comparator 10, the node N2 becomes a high level in accordance with the static current source Is, the PMOS transistor M2 and the resistance R, and the inverter IN1 outputs a low level CMOS signal N3. As a result, the voltage Vgs between gate and source of the PMOS transistor M3 is increased in accordance with the low level CMOS signal N3, thereby strengthening the driving capability of the second current supply unit 18. Therefore, the load circuit 14 received the currents I1, I2 from the first and second current supply units 12, 18, thereby forming a stable internal voltage Vint.

Then, when the internal voltage Vint is increased and accordingly the reference voltage Vref is increased, respective operations of the first and second current supply units 12, 18 and the level converter 16 are stopped in accordance with the high level comparison signal N1 from the comparator 10, thereby interrupting the current supply toward the load circuit 14.

Consequently, the voltage drop circuit according to the present invention repeatedly implements the above operation whenever the internal voltage Vint becomes less than the reference voltage Vref, thereby maintaining the internal voltage Vint at a constant level.

As described above, the voltage drop circuit according to the present invention overcomes deterioration of current driving capability of the current supply unit, which may occur when the external voltage is decreased to a low voltage, thereby realizing the stable supply of internal voltage.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. A voltage drop circuit, comprising:

a comparator for comparing a predetermined reference voltage and a generated internal voltage;

a first current supply unit for being activated in accordance with an output of the comparator;

a level converter for converting the output of the comparator to a CMOS level;

a second current supply unit for being activated in accordance with an output of the level converter; and a load circuit for receiving current from the first and second current supply units and forming an internal voltage;

wherein said level converter comprises:

a static current source serially connected between an external voltage and a ground voltage;

a first PMOS transistor and a resistance electrically coupled to said static current source; and an inverter connected between a drain of the first PMOS transistor and the second current supply unit.

2. The circuit of claim 1, wherein the first and second current supply units respectively comprise a PMOS transistor connected between an external voltage and an output terminal thereof.

3. The circuit of claim 1, wherein the resistance comprises a second PMOS transistor which is constantly turned on, and a turn-on resistance of the second PMOS transistor is larger than a turn-on resistance of the first PMOS transistor.

* * * * *